United States Patent [19]

Cosco et al.

[11] 4,139,805

[45] Feb. 13, 1979

[54] MULTIFLASH SYSTEM

[75] Inventors: Robert J. Cosco, Amesbury; Jeffrey D. Ingalls, Ipswich, both of Mass.

[73] Assignee: GTE Sylvania Incorporated, Stamford, Conn.

[21] Appl. No.: 865,404

[22] Filed: Dec. 29, 1977

[51] Int. Cl.[2] ..... H05B 41/34

[52] U.S. Cl. ..... 315/241 R; 315/188; 315/234; 315/323; 315/324; 315/335; 313/217

[58] Field of Search ..... 315/186–189, 315/231, 232, 234, 241 R, 241 S, 241 P, 323, 324, 335, 337; 313/197, 198, 217, 305

[56] References Cited

U.S. PATENT DOCUMENTS

| | | | |
|---|---|---|---|
| 2,485,037 | 10/1949 | Clark | 315/188 |
| 4,004,189 | 1/1977 | Cosco et al. | 315/335 |

FOREIGN PATENT DOCUMENTS

| | | | |
|---|---|---|---|
| 1292136 | 3/1969 | Fed. Rep. of Germany | 315/241 R |

*Primary Examiner*—Eugene R. LaRoche
*Attorney, Agent, or Firm*—Edward J. Coleman

[57] ABSTRACT

A multiflash system including an arc discharge flashlamp having an elongated tubular envelope and containing three electrodes. A direct current voltage source comprising a large storage bank with positive and negative terminals is connected across two of the electrodes, and a storage capacitor is connected between the third electrode and the negative terminal of the source. The capacitor-connected electrode defines a first arc path with the electrode connected to the positive terminal of the source and a second arc path with the electrode connected to the negative terminal of the source. Trigger pulses are applied to the lamp so as to alternately energize the first and second arc paths, the storage capacitor being charged when the first arc path is energized to flash and discharged when the second arc path is energized to flash.

8 Claims, 6 Drawing Figures

MULTIFLASH SYSTEM

BACKGROUND OF THE INVENTION

This invention relates generally to arc discharge flash lamp systems and, more particularly, to a more efficient multiflash system.

Multiflash systems are employed in a variety of applications; for example, reprographic machines; laser excitation; and warning flashers on airplanes, towers, road barriers, marine equipment and tower monitored lighting systems for airport runways.

Flash tubes generally comprise two spaced apart electrodes within an hermetically sealed glass envelope having a rare gas fill, typically xenon, at a subatmospheric pressure. Such lamps are connected across one or more storage capacitors charged to a substantial potential, which is, however, insufficient to ionize the xenon gas fill. Upon application of an additional pulse of sufficient voltage, the xenon is ionized and an electric arc is formed between the two electrodes, discharging the capacitor through the flash tube, which emits a burst of intense light. In many cases the pulse voltage is applied between an external trigger wire wrapped around the envelope and the electrodes; this is referred to as shunt triggering. However, in other cases an external wire is not feasible since it may result in an undesirable arcing between the trigger wire and a proximate lamp reflector or else the high potential applied to the external trigger wire might be hazardous to operating personnel. In those cases, the lamp may be internally triggered by applying the pulse voltage directly across the lamp electrodes, a technique referred to as injection triggering. Usually the voltage required is about 30 to 50 percent higher than that required to trigger the same lamp with external trigger wire, and the trigger transformer secondary must carry the full lamp current.

In applications requiring two (or more) flash lamps, the lamps have been series-connected across the storage capacitor means, with a single injection trigger circuit being used for the series lamp combination. Whether using one lamp or a plurality of lamps, the general operation of the prior flash circuits comprised charging the storage capacitor means; typically through a resistor, to a predetermined level of voltage, then, on command, triggering the lamp (or lamps) into ionization and thereby discharging the capacitor means through the ionized lamp (or lamps). The energy thus developed in the lamp (or set of lamps) is equal to one-half of the capacitance of the storage means multiplied by the square of the charged voltage. Accordingly, this conventional method of operation results in the waste of a considerable amount of energy in charging the storage capacitor means through a power dissipating resitor. Further, time is wasted in "coming up to charge", or the storage capacitor means must be maintained in a fully charged state until called upon to flash the lamp.

One approach for overcoming the aforementioned shortcomings of conventional flash lamp arrangements is described in a copending application Ser. No. 865,405 filed concurrently herewith and assigned to the present assignee. Briefly, the operating circuit of this copending application uses the charging current of the storage capacitor as well as the discharge current for purposes of lamp energization. More specifically, first and second arc discharge flash lamps are series connected across a supply voltage source comprising a direct current storage bank. The storage capacitor is connected between the junctions of the lamps and one terminal of the source. Respective injection or shunt means are provided for coupling trigger pulses to each lamp, and a succession of high-voltage trigger pulses are alternately applied through the respective coupling means to the lamps. Each trigger pulse applied to the first lamp effects an arc path therethrough for charging the capacitor, and each trigger pulse applied to the second lamp effects an arc path therethrough for discharging the capacitor. Hence, the storage capacitor is charged through one lamp and discharged through the other in response to trigger pulses, which are applied in alternate sequence to the lamps. In essence, the lamps function as alternately actuated switches for charging and discharging the capacitor.

The flashes can be synchronized so that the human eye cannot perceive any variation in time between the flashes, e.g., four milliseconds between flashes. Such multiflash capability for predetermined durations is particularly useful for reprographic applications.

Efficiency is significantly increased by the elimination of power dissipating and time consuming charging resistors. The capacitor means delivers approximately twice the normal power to the lamp by virtue of its charging current as well as its discharge current. Accordingly, the capacitance for a given multiflash system in which the charge cycle is used for lamp energization, as well as the discharge cycle, may be approximately one half that required for the storage capacitor of a comparable system (i.e., same voltage and joule rating) employing a conventional resistor charge circuit. As a result, the circuit permits the use of a smaller capacitor with attendant reductions in cost and package size.

Further, the tendency of the arc discharge to hang on is reduced as each lamp functions as a switch, and the buildup of the voltage on the storage capacitor with respect to the source causes the first lamp (during the charge cycle) to extinguish at the proper time. During the discharge cycle, the second lamp extinguishes due to the limited energy capacity of the storage capacitor with respect to the source.

The present invention provides a multiflash system concept which incorporates principles of the abovementioned copending application but provides significant advantages in efficiency, cost and performance.

SUMMARY OF THE INVENTION

Accordingly, it is an object of the present invention to provide an improved multiflash system.

It is a particular object of the invention to optimize the efficiency and operation of an arc discharge lamp multiflash system.

These and other objects and features are attained, in accordance with the principles, of the present invention by using a three-electrode flash lamp in combination with the operating circuit of the aforementioned copending application. More specifically, a first electrode of the lamp is connected to the positive terminal of a direct current (DC) source comprising a storage means; a storage capacitor means is connected between a second electrode of the lamp and the negative terminal of the source; and a third electrode of the lamp is connected to the negative terminal of the DC source. Means is coupled to the flash lamp for successively applying high voltage trigger pulses thereto, one of the trigger pulses effecting an arc path between the first and second electrodes for charging the capacitor means through the lamp, and the next following trigger pulse effecting an arc path between the second and third electrodes for discharging the capacitor through the lamp. The charge and discharge producing pulses are, thus, applied in alternate sequence to the flash lamp.

According to one embodiment, the first and third electrodes are disposed at opposite ends of a tubular lamp envelope, and the second electrode is disposed in the envelope between the first and second electrodes to thereby provide first and second arc paths through respective portions of the envelope between the first and second electrodes and the second and third electrodes. In another embodiment, the first and third electrodes are disposed at one end of the lamp envelope, and the second electrode is disposed at the other end of the envelope. In both embodiments, the first electrode functions solely as an anode; the third electrode functions solely as a cathode; and the second electrode functions alternately as a cold cathode and anode. Hence, the three-electrode flash lamp of the present invention distinguishes from that described in U.S. Pat. No. 4,004,189, wherein two separate arc discharge paths are defined simultaneously (not in alternate sequence) between a pair of anode electrodes and a cathode-electrode common to both.

The use of a single three-electrode lamp in an operating circuit which provides lamp flashing on both charge and discharge cycles results in a significant optimization of the overall system efficiency. The respective arc path impedance characteristics are more readily matched in a single envelope. The cost of the system is reduced as a single lamp envelope with three electrodes is employed in lieu of two separate, sealed envelopes with a total of four electrodes. When uniformity of illumination is important, the three-electrode lamp minimizes electrode caused dark spaces for a given area of illumination, as compared to a two-lamp system. A further advantage of the single three-electrode envelope over two lamps is that the gas pressure in the entire tube increases and decreases simultaneously thereby generating even light distribution over the entire span including the first and second arc paths.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
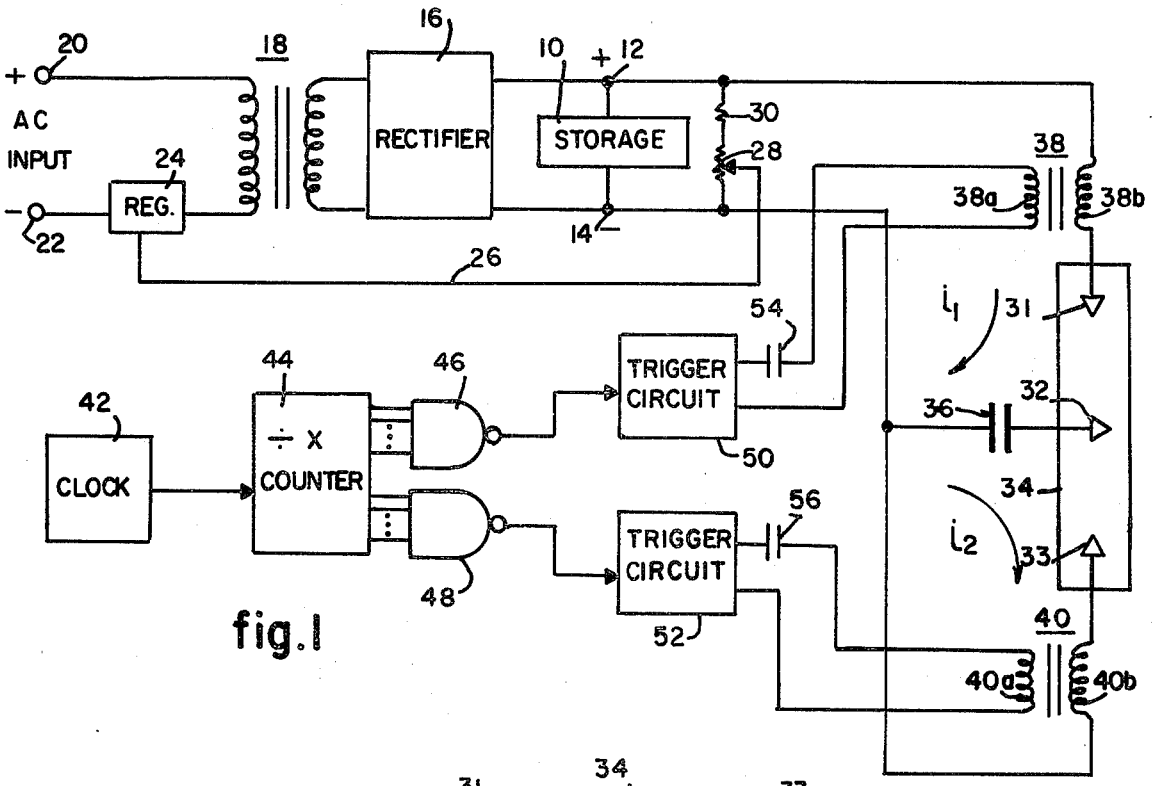
FIG. 1 is a simplified schematic diagram of a multiflash system according to the invention in which the three-electrode lamp is injection triggered.

One embodiment of the multiflash system according to the invention is illustrated in FIG. 1. The supply voltage source for the operating circuit is illustrated as comprising a direct current storage means 10, such as a bank of capacitors, having a positive terminal 12 and a negative terminal 14. The storage bank 10 is energized by a regulated direct current (DC) supply comprising a rectifier 16, such as a full wave diode bridge, connected across the secondary of a step-up power transformer 18, the primary of which is connected to an alternating current (AC) source, represented by terminals 20 and 22. The AC source may be a conventional 120 volt, 60 Hertz power line. A conventional regulator circuit 24 is shown in series with the primary of transformer 18, with the feedback signal for controlling the regulator being tapped via line 26 connected to a variable resistor 28, which is connected in series with a resistor 30 across the DC storage terminals 12 and 14.

In accordance with the invention, a three-electrode arc discharge flash lamp 34 is connected across the DC source. More specifically, lamp 34 has an anode electrode 31 connected to the DC storage terminal 12 and a cathode electrode 33 connected to DC terminal 14. Electrode 32 of the lamp alternately functions as cathode and anode, as will be described hereinafter, and a storage capacitor means, such as a single capacitor 36, is connected between electrode 32 and the DC storage terminal 14. Hence, lamp electrodes 31 and 32 and capacitor 36 are series connected across the DC source. In lieu of the illustrated capacitor 36, of course, the storage capacitor means may comprise a bank of two or more capacitors. Typically, the capacitance of DC storage bank 10 is at least ten times greater than the capacitance of capacitor means 36. The two arc paths of lamp 34 defined by electrode pair 31, 32 and electrode pair 32, 33 are injection triggered through respective pulse transformers 38 and 40. The secondary winding **38*b* of pulse transformer 38 is series connected between terminal 12 of the DC source and anode 31, and the secondary winding 40*b* of pulse transformer 40 is series connected between terminal 14 of the DC source and cathode 33**.

In accordance with the invention lamp 34 is operated so that arc paths 31, 32 and 32, 33 flash in alternate sequence by alternately applying a succession of trigger pulses to the primary windings **38*a* and 40*a* of the pulse transformers 38 and 40, respectively. A variety of high voltage trigger pulse generating circuits may be used for this purpose. FIG. 1 shows a preferred implementation of a digital electronic circuit for generating and alternately applying the trigger pulses to transformers 38 and 40. A clock source 42, such as a crystal controlled oscillator energized by the AC input, provides a pulse output to the drive input of a digital counter 44 which functions as a divider circuit. The parallel outputs of the divider-counter 44 are connected to a pair of logic gates 46 and 48, such as the illustrated NAND gates, for providing the desired readout of two pulse trains, with the pulse from one NAND gate occuring in alternate sequence with respect to the pulses from the other NAND gate. These two pulse trains are applied to respective control terminals of trigger circuits 50 and 52, which are respectively associated with pulse transformers 38 and 40. Each of the trigger circuits 50 and 52 may comprise a silicon controlled rectifier (SCR) arranged as a high voltage switch connected across a portion of the bank of capacitors comprising the DC storage means 10. Hence, in response to each pulse applied to the control terminal of the SCR from the output of its associated NAND gate, the SCR is operative to generate a high voltage trigger pulse. The pulse output of trigger circuit 50 is applied via coupling capacitor 54 across the primary winding 38***a* of pulse transformer 38, and the output of trigger circuit 52 is applied via coupling capacitor 56 across the primary winding 40*a* of pulse transformer 40.

In considering the operation of the circuit of FIG. 1, assume that it is desired to flash each arc path of lamp 34 at a rate of n times per second. This is accomplished by providing timing pulses at the output of each NAND gate at a rate of n pulses per second (pps). Each of the resulting high voltage trigger pulses generated at the output of circuit 50 and applied to pulse transformer 38 causes ionization of the gas fill of lamp 34, particularly in the region of arc path 31, 32. If capacitor 36 is at its minimum charge level, the anode 31 to electrode 32 voltage provided by the DC storage source 12, 14 is sufficient to sustain ionization. Lamp 34 will then conduct heavily via the arc path defined between electrodes 31 and 32, to rapidly charge capacitor 36, with the direction of current flow indicated by the arrow labeled $i_1$. In this mode, electrode 32 functions as a cathode. When capacitor 36 is fully charged, the voltage across the lamp electrodes 31, 32 drops below that necessary to sustain ionization, and lamp 34 is reliably extinguished.

Each of the high voltage trigger pulses generated at the output of circuit 52 and applied to pulse transformer 40 causes ionization of the fill gas of lamp 34 particularly in the region of arc path 32, 33. If capacitor 36 is at its fully charged level, the electrode 32 to cathode 33 voltage is sufficient to sustain ionization (the cathode 33 being connected to negative terminal 14). Lamp 34 will then conduct heavily via the arc path defined between electrodes 32 and 33 to rapidly discharge capacitor 36, with the direction of current flow indicated by the arrow labeled $i_2$. In this mode electrode 32 functions as an anode. When capacitor 36 is discharged to its minimum level, the voltage across the lamp electrodes 32, 33 drops below that necessary to sustain ionization, and lamp 34 is reliably extinguished.

Accordingly, it is clear that arc paths 31, 32 and 32, 33 must be triggered to flash in alternate sequence, whereby capacitor 36 is successively charged and discharged. Thus, if each arc path is flashed at a rate of n pps, the flash rate of the lamp 34 is 2n pps.

In a preferred embodiment, the digital counter 44 is adapted to repeatedly count up to x and thereby divide the clock output by x. Accordingly, the clock rate should be set at xn pps in order to result in a divider output of n pps. In order to provide the required alternate triggering of the lamps, NAND gate 46 is connected to the parallel outputs of the digital counter 44 so as to provide an output pulse each time a count of x/2 reached by the counter. NAND gate 48, on the other hand is connected to provide an output pulse each time a count of x is reached. As a result, the output of each gate provides a timing rate of n pulses per second, but the time of occurrence of the pulses from gate 46 are in alternate sequence with respect to the time of occurrence of the pulses from gate 48.

In one particular embodiment of the invention, x was 10, and the clock rate of nx was variable, so that n had a maximum value of 120 pps. Thus, gate 46 provided maximum output of 120 pps with each pulse corresponding to a count of 5 by the digital counter, and gate 48 provided a maximum output of 120 pps with each pulse corresponding to a count of 10. Hence, the maximum flash rate for the combination of two lamps was 240 pps. Capacitor 36 had a value of 10 microfarads, and the storage capacitor bank 10 had a value of about 425 microfarads (a bank of four 1700 μfd capacitors in series). The DC input to the storage bank from rectifier 16 was 1200 volts maximum.

Figure 2:
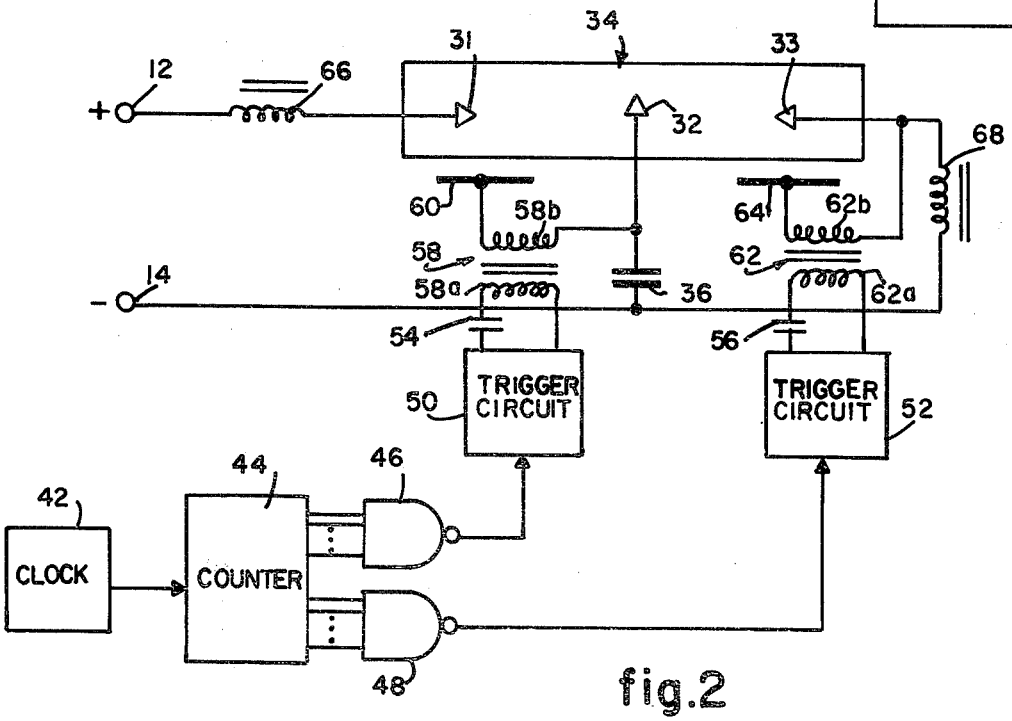
FIG. 2 is a simplified schematic diagram showing a shunt triggering arrangement applied to the multiflash system of the invention.

FIG. 2 illustrates an alternative circuit arrangement wherein the lamps are shunt triggered. Circuit elements similar to those in FIG. 1 are identified with the same reference numerals. In this instance, the output of trigger circuit 50 is connected via coupling capacitor 54 to the primary winding 58*a* of a pulse transformer 58. The secondary winding 58*b* of this pulse transformer is connected between electrode 32 of lamp 34 and an external electrode 60 mounted adjacent to the portion of the lamp 34 envelope through which arc path 31, 32 is provided. In this manner, pulsed high voltage is capacitively coupled to the lamp. For example, external electrode 60 may comprise a conductive element such as a wire wrapped around the lamp envelope. In like manner, trigger circuit 52 is connected via coupling capacitor 56 to the primary 62*a* of pulse transformer 62, and the secondary 62*b* of the pulse transformer is connected between the cathode 33 of lamp 34 and its external electrode 64, which is mounted adjacent to the portion of the lamp 34 envelope through which arc path 31, 32 is provided.

An advantage of the shunt triggering arrangement is that smaller pulse transformers (58, 62) can be used since the secondary does not have to carry the lamp current, as was the case with the injection triggering pulse transformers 38 and 40 of FIG. 1. On the other hand, shunt triggering tends to result in a higher peak current and shorter duration flash; accordingly, it is generally advisable to employ current limiting means in series with the lamps. For example, in FIG. 2, a current limiting inductor 66 is series connected between source terminal 12 and the anode 31 of lamp 34, while a current limiting inductor 68 is series connected between source terminal 14 and the cathode of lamp 34. The operation of the circuit of FIG. 2 is similar to that described above for FIG. 1.

Figure 3:
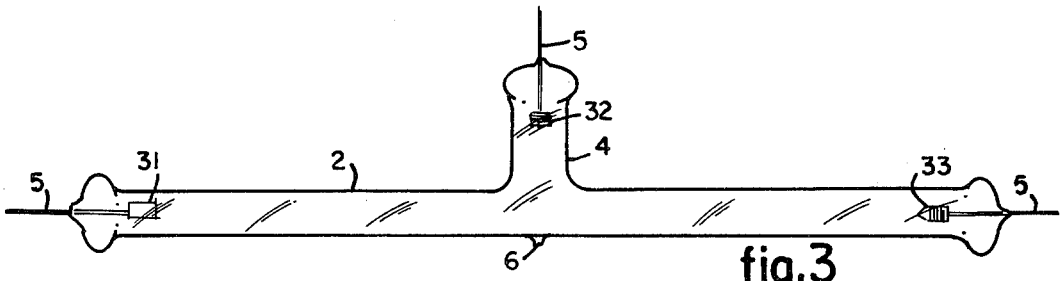
FIG. 3 illustrates one embodiment of a three-electrode flash lamp useful in the system of the invention.

FIG. 3 illustrates one embodiment of a three-electrode lamp suitable for use in the circuits of FIGS. 1 and 2 in accordance with the invention. The lamp comprises an hermetically sealed, light-transmitting envelope 2 formed of an elongated piece of hard glass tubing (e.g., Corning No. 7740 glass) having a generally tubular configuration. The envelope further includes a centrally located glass chamber 4 offset from the elongated tubular portion 2. Electrode 32 is disposed within chamber 4, and electrodes 31 and 33 are disposed at opposite ends of the tubular envelope. Each electrode is attached to a respective rod or lead-in wire 5 which is sealed through the glass envelope. The envelope 2 is filled with a rare gas, such as xenon, at a subatmospheric pressure (e.g. 100 Torr) and is constricted to define an exhaust tip 6.

As electrode 31 functions as an anode it may comprise a rolled tantalum foil, while electrode 33 which functions as a cathode may comprise a pressed and sintered pellet of powdered tantalum and barium aluminate with a 100 percent pitched tungsten coil wound about the cylindrical sidewall of the pellet, such as described in U.S. Pat. No. 3,849,690.

Figure 4:
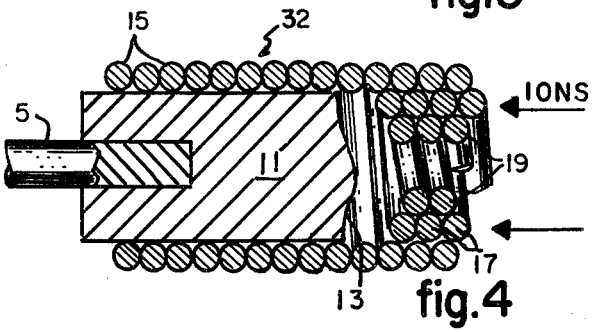
FIG. 4 is an axial section of an electrode assembly useful in the lamp of FIG. 3.

Electrode 32 functions alternately as a cold cathode and anode; i.e. it is a cathode during the charge cycle ($i_1$) via arc path 31, 32 and an anode during the discharge cycle ($i_2$) via arc path 32, 33. To use a cold cathode as an anode in this manner renders the electrode susceptible to evaporation of the emissive material. In accordance with another aspect of the invention, therefore, we have discovered that a particularly useful electrode design for the dual functioning electrode 32 is that described in copending application Ser. No. 692,285, filed June 3, 1976, now U.S. Pat. No. 4,097,774, and assigned to the present assignee. Briefly, the design incorporates a sintered tantalum pellet that is overwound with tungsten that protects the "cathode" from emissive material loss while allowing it to act as an "anode". More specifically, referring to FIG. 4, electrode assembly 32 includes an electron emissive, cold cathode pellet 11 pressed and sintered on the previously described lead wire 5. A suitable pellet composition is 89.5% tantalum forming a getter material matrix for 10%, electron emissive, barium aluminate and 0.5% nickel to which is added the equivalent of 2% wax binder. The right hand curved end 13 of the pellet comprises the electron emissive surface. Around the pellet is a overwind 15 of tungsten or other refractory metal wire extending over a substantial portion of the pellet 11 and beyond the emitting surface 13. For a pellet approximately 0.375 inch long and 0.165 inch in diameter an overwind wire size of 0.030 to 0.040 inch diameter is suitable. Although the flash tube is a cold field emission device some diffusion heating is necessary to replenish emissives at the surface 11, which heating may be reduced by heat sink effect of the overwind. Preferably the overwind 16 is wound at 100% pitch, i.e. adjacent turns touching, but diffusion heating may be controlled by looser winding. The pellet is supported solely by the lead wire 5 so that the overwind 15 may support a further mass of refractory material spaced from the pellet or at least not in intimate contact with the pellet. For example, in FIG. 4, the refractory mass comprises two short inner tungsten wire coils 17 and 19 of progressively smaller diameter threaded inside the overwind 15 and then spot welded in a position spaced from the emissive face 13 of the pellet 11. The inner coils 17 and 19 are preferably of the same diameter wire and pitch as the overwind 15. One or more of these inner coils 17 and 19 shield the emissive face of the pellet 11 by interposition in the ion stream toward the pellet.

With the electrode 32 disposed between the electrodes 31 and 33, the electrode 32 is common to both 31 and 32 during operation of the flash lamp. Hence, upon triggering the flash lamp as described for FIGS. 1 and 2, two separate arc discharge paths are defined through respective portions of the envelope in alternate sequence. That is, one arc discharge path will occur through the left hand section of the tubing between anode 31 and electrode 32 during the capacitor 36 charge cycle $i_1$, while the other discharge path between will follow the right hand section of the tubing between electrode 32 and cathode 33 during the capacitor 36 discharge cycle $i_2$. To assure a balanced light output and flash duration through both sections of tubing upon shunt triggering the lamps, the two discharge paths should have substantially equal impedances. Hence, the glass tubing is formed to have a substantially uniform internal diameter throughout, and the two-discharge paths are dimensioned to have substantially equal lengths, such as by centrally locating the offset chamber 4 on length of glass tubing. In one implementation, each arc path had a length of about 12 inches.

Figure 5:
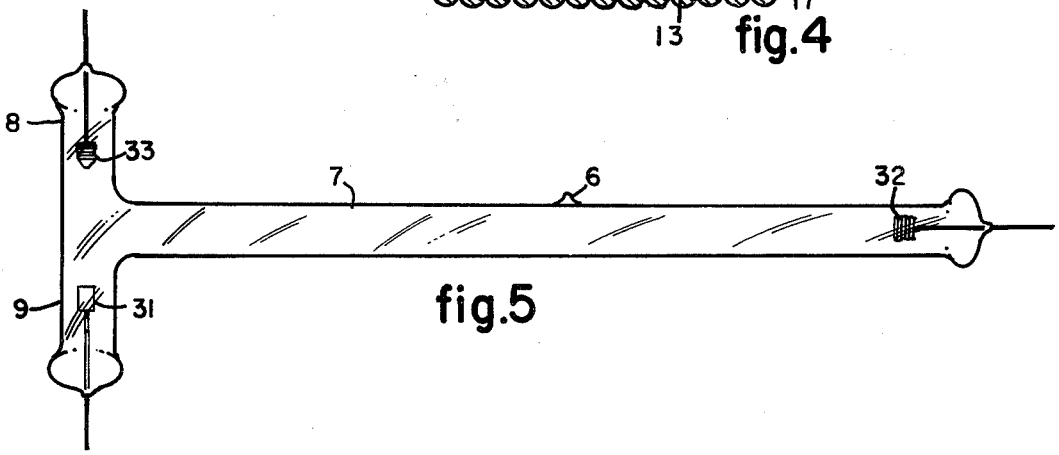
FIG. 5 illustrates another embodiment of a three electrode flash lamp useful in the system of the invention.
Figure 6:
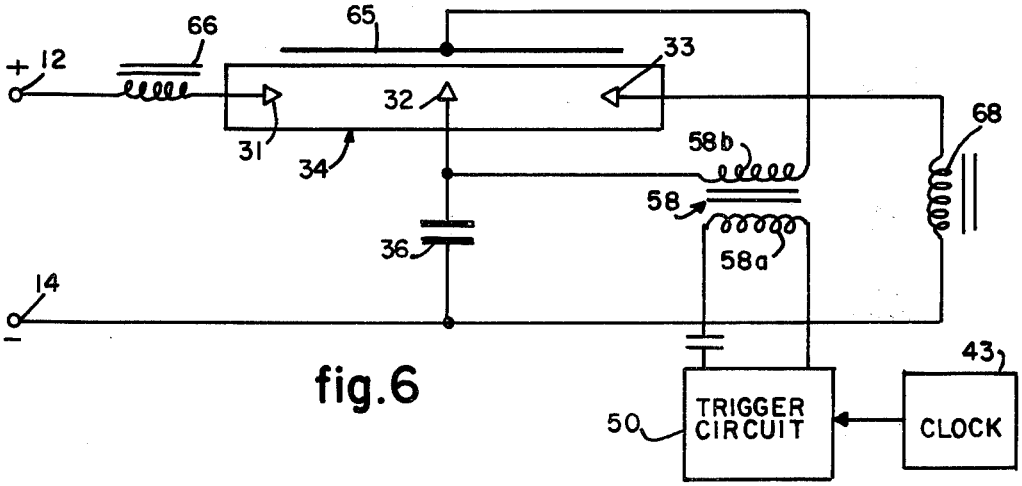
FIG. 6 is a simplified schematic diagram showing an alternative shunt triggering arrangement particularly useful with the lamp of FIG. 5 as applied to the multiflash system of the invention.

FIG. 5 illustrates another embodiment of a three-electrode lamp suitable for use in a system according to the invention. The lamp comprises an hermetically sealed, light-transmitting envelope 7 formed of an elongated piece of hard glass tubing having a generally tubular configuration. In this case, however, the envelope further includes two glass chambers 8 and 9 offset from the elongated tubular portion 7 at one end thereof to provide an overall T-shaped configuration to the envelope. Electrodes 31 and 33 are disposed in chambers 8 and 9, respectively, at one end of the envelope 7, and common electrode 32 is disposed at the opposite end of the envelope. Hence, in the lamp of FIG. 5, both the arc path 31, 32 and arc path 32, 33 are defined through the same portion of envelope 7, the common arc path having a length of 12 inches in one implementation. Accordingly, the shunt triggering circuit may be modified for this lamp as illustrated in FIG. 6. In this instance, only a single conductive element 65 is required as the external electrode; for example, element 65 may comprise a wire wrapped around envelope 7. Hence, a single trigger pulse source is required as both the charge and discharge arc paths 31, 32 and 32, 33 occur through the same portion of envelope 7. Hence, clock source 43 of 2n pulses per second may be applied directly to a trigger circuit 50 for initiating high voltage trigger pulses at a rate of 2n pulses per second to be applied via diode pulse transformer 58. The primary **58*a* of transformer 58 is connected to trigger circuit 50, while the secondary 58*b* is connected between the common electrode 32 and the external electrode 65**.

Although the invention has been described with respect to specific embodiments, it will be appreciated that modifications and changes may be made by those skilled in the art without departing from the true spirit and scope of the invention.

What we claim is

1. A multiflash system comprising, in combination:

an arc discharge flash lamp having an elongated, light-transmitting tubular envelope which is hermetically sealed, a rare gas in said envelope, and first, second and third electrodes in said envelope;

a supply voltage source comprising a direct current storage means having first and second terminals of opposite polarity connected across the first and third electrodes, respectively, of said lamp;

a storage capacitor means connected between the second electrode of said lamp and the second terminal of said source, whereby said first and second lamp electrodes and said capacitor means are series connected across said supply voltage source; and means coupled to said flash lamp for successively applying high voltage trigger pulses thereto, one of said trigger pulses effecting an arc path between first and second electrodes for charging said capacitor means through said lamp, and the next following of said trigger pulses effecting an arc path between said second and third electrodes for discharging said capacitor means through said lamp, said charge and discharge producing trigger pulses being applied in alternate sequence to said flash lamp.

2. The system of claim 1 wherein said last-mentioned means is an injection triggering means comprising first and second pulse transformers each aving primary and secondary windings, the secondary winding of said first pulse transformer being series connected between the first terminal of said source and the first electrode of said lamp, the secondary winding of said second pulse transformer being series connected between the third electrode of said lamp and the second terminal of aaid source, and means for generating and alternately applying a succession of voltage pulses to the primary windings of said first and second pulse transformers.

3. The system of claim 2 wherein the capacitance of said storage means of the supply voltage source is at least ten times greater than the capacitance of said storage capacitor means.

4. The system of claim 2 wherein said first and third electrodes are disposed at opposite ends of said tubular lamp envelope, and said second electrode is disposed in said envelope between said first and third electrodes to thereby provide two separate arc paths through respective portions of said envelope between said first and second electrodes and said second and third electrodes.

5. The system of claim 1 wherein said last-mentioned means is a shunt triggering means comprising conductive means adjacent to the envelope of said flash lamp, and trigger pulse generating means coupled to said conductive means, and wherein said system further includes a first current limiting means series connected between the first terminal of said source and the first electrode of said lamp, and a second current limiting means series connected between the third electrode of said lamp and the second terminal of said source.

6. The system of claim 5 wherein said first and third electrodes are disposed at opposite ends of said tubular lamp envelope, said second electrode is disposed in said envelope between said first and third electrodes to thereby provide two separate arc paths through respective portions of said envelope between the first and second electrodes and second and third electrodes, said conductive means includes first and second separate conductive elements respectively adjacent to the two portions of said envelope through which the two separate arc paths are provided, and said trigger pulse generating means alternately applies a succession of voltage pulses to said first and second conductive elements adjacent the respective envelope portions.

7. The system of claim 1 wherein said first and third electrodes are disposed at one end of said envelope, and said second electrode is disposed at the opposite end of said envelope.

8. The system of claim 1 wherein said first electrode is an anode; said third electrode is a cathode; and said second electrode functions alternately as a cold cathode and anode; said second electrode being an assembly comprising a lead wire extending into said envelope, a discrete body disposed on the lead wire and containing a sintered compound of electron emissive material, a mass of refractory metal material disposed to shield a substantial emissive area of said body, and means extending from said body to the refractory mass for holding the mass in spaced relation to the body thereby to expose the shielded area for electron emission.

* * * * *